US008277255B2

(12) United States Patent
Consoli et al.

(10) Patent No.: US 8,277,255 B2
(45) Date of Patent: Oct. 2, 2012

(54) INTERCONNECT MEMBER FOR AN ELECTRONIC MODULE WITH EMBEDDED COMPONENTS

(75) Inventors: John J Consoli, Harrisburg, PA (US); Attalee S Taylor, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 3 days.

(21) Appl. No.: 12/965,468

(22) Filed: Dec. 10, 2010

(65) Prior Publication Data

US 2012/0149215 A1 Jun. 14, 2012

(51) Int. Cl.
*H01R 13/66* (2006.01)

(52) U.S. Cl. ..... 439/620.2; 439/66

(58) Field of Classification Search ..... 439/66, 439/71, 620.15, 620.2
See application file for complete search history.

(56) References Cited

U.S. PATENT DOCUMENTS 5,819,809 A * 10/1998 Bassi et al. ..... 139/85
5,967,848 A * 10/1999 Johnson et al. ..... 439/620.21
6,005,778 A 12/1999 Spielberger et al.
6,049,465 A 4/2000 Blish, II et al.
6,222,260 B1 4/2001 Liang et al.
6,700,794 B2 3/2004 Vinson et al.
7,261,568 B2 * 8/2007 Ju et al. ..... 439/66
7,438,586 B2 * 10/2008 Ju ..... 439/398
7,737,708 B2 * 6/2010 Sherry ..... 324/762.03
7,841,864 B2 * 11/2010 Hsiao et al. ..... 439/66
8,039,944 B2 * 10/2011 Ju ..... 257/690

* cited by examiner

*Primary Examiner* — Thanh Tam Le

(57) ABSTRACT

An interconnect member is provided for electrically connecting an electronic module to a printed circuit. The interconnect member includes a substrate having a module side and an opposite circuit side. Module contacts are held by the substrate. The module contacts are arranged within an array along the module side of the substrate. The module contacts include module mating interfaces that are configured to be electrically connected to the electronic module. Circuit contacts are held by the substrate. The circuit contacts are arranged within an array along the circuit side of the substrate. The circuit contacts include circuit mating interfaces that are configured to be electrically connected to the printed circuit. Electrical components extend between and electrically connect corresponding module contacts to corresponding circuit contacts to provide electrical paths for electrical signals transmitted between the module and circuit contacts. At least one of the electrical components modifies the corresponding electrical signal transmitted along the electrical path between the corresponding module and circuit contacts.

18 Claims, 5 Drawing Sheets

INTERCONNECT MEMBER FOR AN ELECTRONIC MODULE WITH EMBEDDED COMPONENTS

BACKGROUND OF THE INVENTION

The subject matter described and/or illustrated herein relates generally to electronic modules, and more particularly, to interconnect members for electrically connecting an electronic module to a printed circuit.

Competition and market demands have continued the trend toward smaller and higher performance (e.g., faster) electronic systems. To achieve such reduced sized and higher performance systems, electronic modules have become more complex. For example, electronic modules are being designed to switch more and more driver and receiver circuits at higher and higher speeds. Examples of electronic modules include chips, packages, processors, microprocessors, central processing units (CPUs), memories, integrated circuits, application specific integrated circuits (ASIC), and/or the like. Electronic modules are typically mounted on printed circuits (sometimes referred to as "circuit boards" or "printed circuit boards") within a larger, or host, electronic system.

Electronic modules may suffer from unintended direct current (DC) coupling between the electronic module and other components of the larger system, such as another electronic module. For example, driver and receiver circuits of the electronic module and the other component may be unintentially DC coupled. Unintentional DC coupling can negatively impact electrical performance of the electronic system. For example, unintentional DC coupling may generate noise along the signal paths of the electronic system. Unintentional DC coupling may be particularly troublesome for electronic systems that transmit high speed (e.g., above approximately 1 gigabits per second (Gbps)) differential signals.

One technique for blocking DC coupling between the electronic module and other components of the electronic system includes positioning discrete DC blocking components (e.g., capacitors) within the signal paths of the printed circuit on which the electronic module is mounted. However, only a limited amount of space is available on the printed circuit on which the electronic module is mounted. For example, due to the increased demand for smaller electronic packages and higher signal transmission speeds, printed circuits may not have room for discrete DC blocking components. Moreover, adding discrete DC blocking components within the signal paths of the printed circuit may negatively impact the electrical performance of the printed circuit. For example, the DC blocking components may necessitate a less than optimal relative arrangement of the various signal paths along the printed circuit, which may add noise and/or reduce signal transmission rates along the signal paths. Moreover, parasitic inductance, capacitance, resistance, and/or the like of the discrete DC blocking components may also negatively impact the electrical performance of the printed circuit on which the electronic module is mounted.

Another technique for blocking DC coupling between an electronic module and other components of a larger electronic system includes positioning discrete DC blocking components within an electrical connector that electrically connects the printed circuit on which the electronic module is mounted to the other component. But, DC blocking components located within such electrical connectors may not be close enough to the electronic module to be effective to block DC coupling between the electronic module and the other component of the larger system.

BRIEF DESCRIPTION OF THE INVENTION

In one embodiment, an interconnect member is provided for electrically connecting an electronic module to a printed circuit. The interconnect member includes a substrate having a module side and an opposite circuit side. Module contacts are held by the substrate. The module contacts are arranged within an array along the module side of the substrate. The module contacts include module mating interfaces that are configured to be electrically connected to the electronic module. Circuit contacts are held by the substrate. The circuit contacts are arranged within an array along the circuit side of the substrate. The circuit contacts include circuit mating interfaces that are configured to be electrically connected to the printed circuit. Electrical components extend between and electrically connect corresponding module contacts to corresponding circuit contacts to provide electrical paths for electrical signals transmitted between the module and circuit contacts. At least one of the electrical components modifies the corresponding electrical signal transmitted along the electrical path between the corresponding module and circuit contacts.

In another embodiment, an electronic module assembly includes a printed circuit, an electronic module, and an interconnect member that electrically connects the electronic module to the printed circuit. The interconnect member includes a substrate having a module side and an opposite circuit side. Module contacts are held by the substrate. The module contacts are arranged within an array along the module side of the substrate and include module mating interfaces that are electrically connected to the electronic module. Circuit contacts are held by the substrate. The circuit contacts are arranged within an array along the circuit side of the substrate and include circuit mating interfaces that are electrically connected to the printed circuit. Electrical components extend between and electrically connect corresponding module contacts to corresponding circuit contacts to provide electrical paths for electrical signals transmitted between the module and circuit contacts. At least one of the electrical components modifies the corresponding electrical signal transmitted along the electrical path between the corresponding module and circuit contacts.

In another embodiment, an interconnect member is provided for electrically connecting an electronic module to a printed circuit. The interconnect member includes a substrate having a module side and an opposite circuit side. Module contacts are held by the substrate. The module contacts are arranged within an array along the module side of the substrate and include module mating interfaces that are configured to be electrically connected to the electronic module. Circuit contacts are held by the substrate. The circuit contacts are arranged within an array along the circuit side of the substrate and include circuit mating interfaces that are configured to be electrically connected to the printed circuit. Electrical components extend between and electrically connect corresponding module contacts to corresponding circuit contacts to provide electrical paths between the module and circuit contacts. At least one of the electrical components includes at least one of a capacitor, a resistor, a diode, a transistor, a transducer, or a switch.

DETAILED DESCRIPTION OF THE INVENTION

Figure 1:
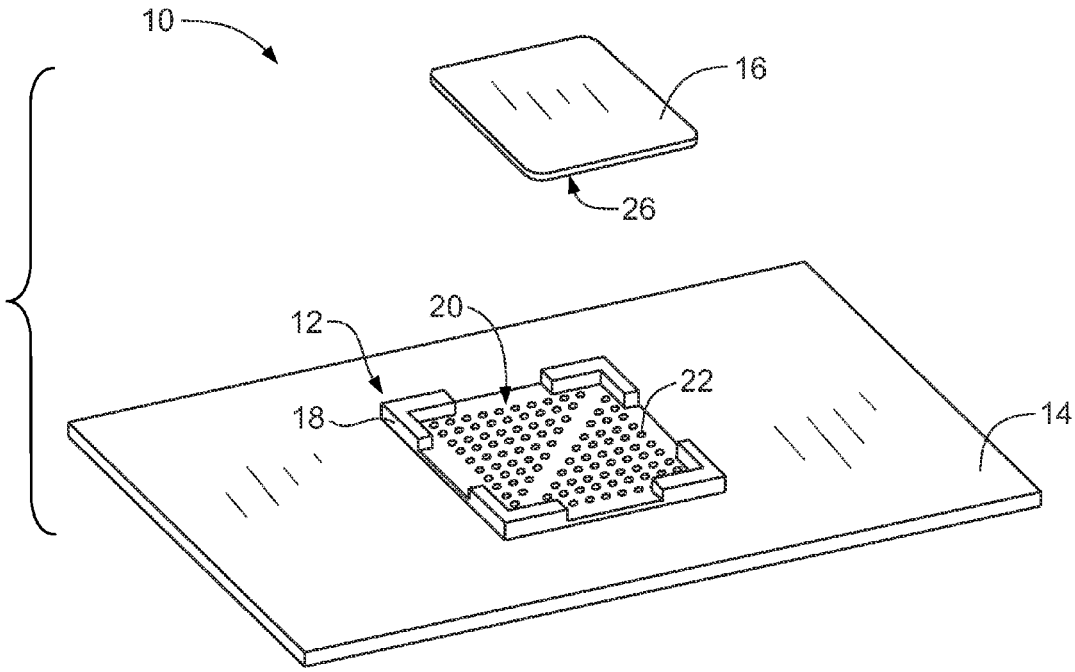
FIG. 1 is a partially exploded perspective view of an exemplary embodiment of an electronic module assembly.

FIG. 1 is a partially exploded perspective view of an exemplary embodiment of an electronic module assembly 10. The electronic module assembly 10 includes an electrical connector 12, a printed circuit 14, and an electronic module 16. The electrical connector 12 is mounted on the printed circuit 14. The electronic module 16 is loaded onto the electrical connector 12 to electrically connect the electronic module 16 to the printed circuit 14 via the electrical connector 12. Optionally, the electrical connector 12 is a socket connector. The electronic module 16 may be any type of electronic module, such as, but not limited to, a chip, a package, a processor, a microprocessor, a central processing unit (CPU), a memory, an integrated circuit, an application specific integrated circuit (ASIC), and/or the like.

Figure 2:
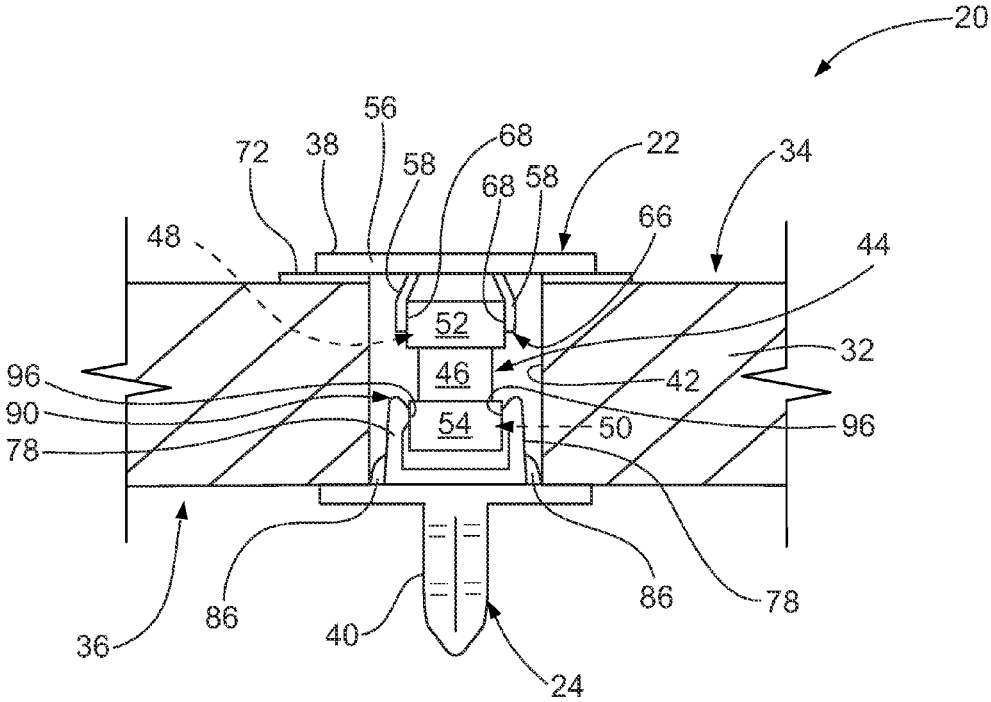
FIG. 2 is a cross-sectional view of a portion of an exemplary embodiment of an interconnect member of the electronic module assembly shown in FIG. 1.
Figure 4:
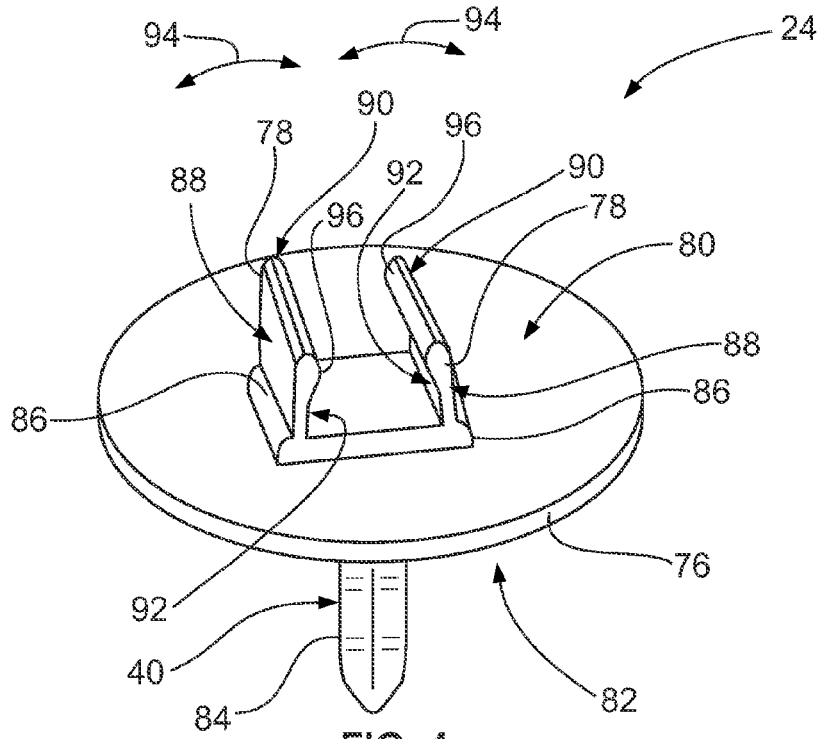
FIG. 4 is a perspective view of an exemplary embodiment of another electrical contact of the interconnect member shown in FIG. 2.
Figure 5:
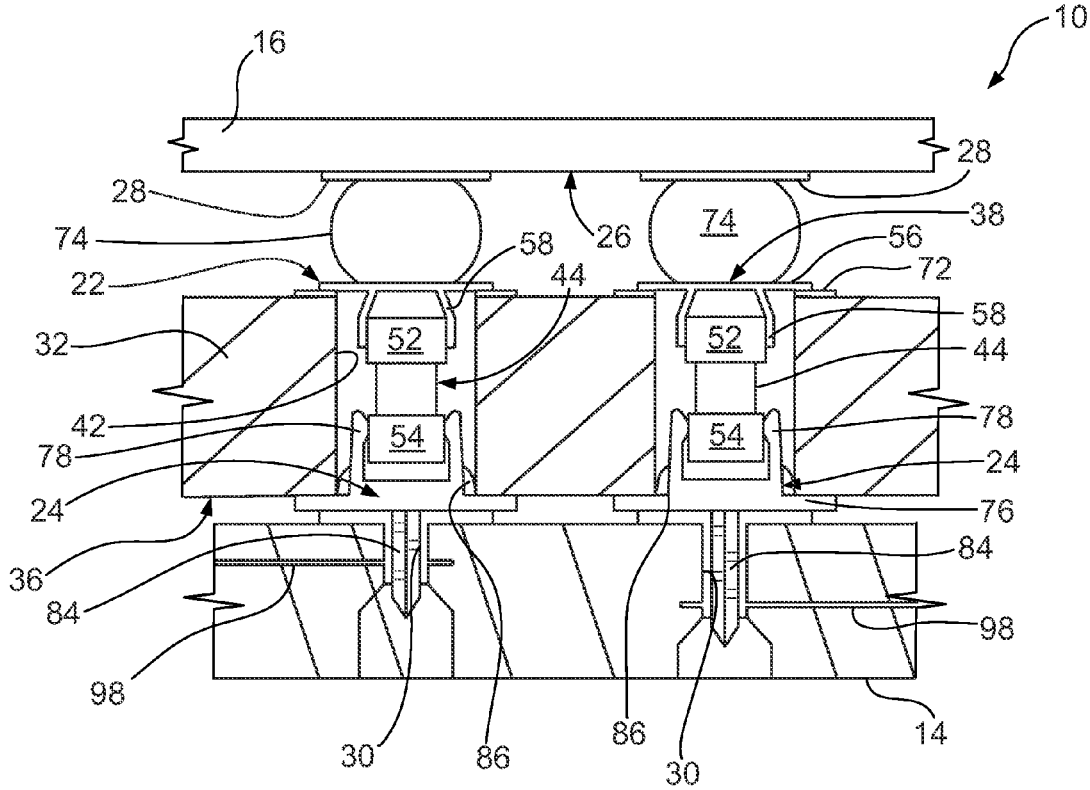
FIG. 5 is a cross-sectional view of a portion of the electronic module assembly shown in FIG. 1.

The electrical connector 12 includes a dielectric alignment frame 18 that is mounted on the printed circuit 14. The alignment frame 18 is a component of an interconnect member 20 that includes an array of electrical contacts 22 and an array of electrical contacts 24 (FIGS. 2, 4, and 5). The electronic module 16 has a mating side 26 along which the electronic module 16 mates with the interconnect member 20. In the exemplary embodiment, the interconnect member 20 is interposed between contact pads 28 (FIG. 5) on the mating side 26 of the electronic module 16 and corresponding electrical vias 30 (FIG. 5) of the printed circuit 14 to electrically connect the electronic module 16 to the printed circuit 14. The electrical contacts 22 may be referred to herein as "module contacts", while the electrical contacts 24 may be referred to herein as "circuit contacts". The contact pads 28 may be referred to herein as "electrical contacts".

FIG. 2 is a cross-sectional view of a portion of an exemplary embodiment of the interconnect member 20. The interconnect member 20 includes a dielectric substrate 32 that holds the electrical contacts 22 and 24. The substrate 32 includes a module side 34 and an opposite circuit side 36. The electrical contacts 22 are arranged within an array along the module side 34 of the substrate 32 for electrical connection to the electronic module 16 (FIGS. 1 and 5). Each electrical contact 22 includes a mating interface 38 that is configured to be electrically connected to a corresponding one of the contact pads 28 (FIG. 5) on the mating side 26 (FIGS. 1 and 5) of the electronic module 16. The array of electrical contacts 22 may include any number of electrical contacts 22 overall and the contacts 22 may be arranged in any pattern having any number of rows and columns. The pattern of the array of electrical contacts 22 shown in FIG. 1 is meant as exemplary only. The mating interfaces 38 may be referred to herein as "module mating interfaces".

The electrical contacts 24 are arranged within an array along the circuit side 36 of the substrate 32 for electrical connection to the printed circuit 14 (FIGS. 1 and 5). The electrical contacts 24 include mating interfaces 40 that are configured to be electrically connected to corresponding electrical vias 30 (FIG. 5) of the printed circuit 14. The array of electrical contacts 24 may include any number of electrical contacts 24 overall and the contacts 24 may be arranged in any pattern having any number of rows and columns. The mating interfaces 40 may be referred to herein as "circuit mating interfaces".

The substrate 32 includes an array of openings 42 that extend through the substrate 32. More particularly, the openings 42 extend through both of the module and circuit sides 34 and 36, respectively, and completely through the substrate 32 between the sides 34 and 36. The array of openings 42 is aligned with the arrays of the electrical contacts 22 and 24 such that the electrical contacts 22 are aligned with corresponding openings 42 on the module side 34 of the substrate 32 and the electrical contacts 24 are aligned with corresponding openings 42 on the circuit side 36. The interconnect member 20 includes a plurality of electrical components 44. Each electrical component 44 is held within a corresponding opening 42 and is electrically connected to the corresponding electrical contacts 22 and 24. Within the corresponding opening 42, the electrical component 44 extends between and electrically connects the corresponding electrical contacts 22 and 24 together. Each electrical component 44 thereby provides an electrical path through the substrate 32 for electrical signals transmitted between the corresponding electrical contacts 22 and 24. Each electrical signal transmitted between corresponding contacts 22 and 24 may be a data signal, electrical power, and/or the like.

Each of the electrical components 44 modifies the corresponding electrical signal that is transmitted along the electrical path defined by the electrical component 44 between the corresponding electrical contacts 22 and 24. As used herein, modifying the corresponding electrical signal is intended to mean any functionality of the electrical component 44 that is performed by the electrical component 44 in addition to providing the electrical path between the corresponding electrical contacts 22 and 24. In other words, in addition to merely transmitting the corresponding electrical signal in at least one direction between the corresponding electrical contacts 22 and 24, the electrical components 44 modify the corresponding electrical signals by providing one or more different (with respect to the transmission) functionalities relative to the corresponding electrical signals. Each electrical component 44 may modify the corresponding electrical signal in any manner, fashion, way, and/or the like. For example, each electrical component 44 may modify the corresponding electrical signal by blocking direct current (DC) in at least one direction along the electrical path between the corresponding electrical contacts 22 and 24, by switching the electrical path between the corresponding electrical contacts 22 and 24 between an open and closed state, by amplifying the corresponding electrical signal, and/or the like. Other examples of modifying the corresponding electrical signal include smoothing an output of the corresponding electrical signal, storing electrical energy of the corresponding electrical signal, limiting the flow of electrical current of the corresponding electrical signal, and/or the like. Still more examples of modifying the corresponding electrical signal include blocking transmission of the corresponding electrical signal in one direction along the electrical path between the corresponding electrical contacts 22 and 24, converting the corresponding electrical signal into a different form of energy, and/or the like. In the exemplary embodiment of the electrical components 44, the electrical components 44 include DC blocking components that facilitate blocking DC coupling between the electronic module 16 and another component (not shown) within a larger, or host, electronic system (not shown) that includes the electronic module assembly 10.

The electrical components 44 may each include any type of electrical component that modifies the corresponding electrical signal in any manner, fashion, way, and/or the like. Examples of the electrical components 44 include, but are not limited to, capacitors, resistors, diodes, transistors, transducers, switches, active electrical components, passive electrical components, and/or the like. For example, one or more of the electrical components 44 may include a capacitor for, for example, blocking direct current (DC) in at least one direction along the electrical path between the corresponding electrical contacts 22 and 24, for smoothing an output of the corresponding electrical signal, for storing electrical energy of the corresponding electrical signal, and/or the like. Moreover, and for example, one or more of the electrical components 44 may include a resistor for, for example, limiting the flow of electrical current of the corresponding electrical signal, and/or the like. One or more of the electrical components 44 may include a diode for, for example, blocking transmission of the corresponding electrical signal in one direction along the electrical path between the corresponding electrical contacts 22 and 24, and/or the like. Other examples include embodiments wherein one or more of the electrical components 44 may include a transistor for, for example, switching the electrical path between the corresponding electrical contacts 22 and 24 between an open and closed state, for amplifying the corresponding electrical signal, and/or the like. Yet another example includes embodiments wherein one or more of the electrical components 44 includes a switch for, for example, switching the electrical path between the corresponding electrical contacts 22 and 24 between an open and closed state, and/or the like. Moreover, one or more of the electrical components 44 may include a transducer for, for example, converting the corresponding electrical signal into a different form of energy, and/or the like. When an electrical component 44 includes a transducer for converting the corresponding electrical signal into a different form of energy, the electrical signal may be converted into any other form of energy, such as, but not limited to, electro-mechanical energy, electromagnetic energy, photonic energy, optical energy, photovoltaic energy, and/or the like. In some embodiments wherein an electrical component 44 includes a transducer, the electrical component 44 may be used as a sensor, detector, and/or the like.

As described above, in the exemplary embodiment of the electrical components 44, each of the electrical components 44 includes a DC blocking component that facilitates blocking DC coupling. For example, the electrical components 44 block DC from being transmitted in at least one direction along the electrical paths between the electrical contacts 22 and 24. The electrical components 44 may each include any component that is configured to facilitate blocking DC. In the exemplary embodiment, the electrical components 44 include capacitors that may each be any type of capacitor having any overall construction. Examples of capacitors that may be used as a DC blocking component include, but are not limited to, parallel plate capacitors, fixed capacitors, variable capacitors, gimmick capacitors, trimmer capacitors, electrolytic capacitors, printed circuit board capacitors, integrated circuit capacitors, vacuum capacitors, an active capacitor, a passive capacitor, and/or the like. In addition or alternatively to including a capacitor, one or more of the electrical components 44 may include any other type of component that is configured to facilitate blocking DC, such as, but not limited to, a resistor, a diode, an active component, a passive component, and/or the like.

Each electrical component 44 includes a body 46 that extends a length from a module end 48 to a circuit end 50. In the exemplary embodiment, the body 46 has the shape of a parallelepiped. In other words, the exemplary embodiment of the body 46 of each electrical component 44 has a rectangular cross-sectional shape. But, the body 46 of each electrical component 44 may additionally or alternatively include any other shape. Optionally, the electrical components 44 include a cap 52 on the module end 48 and/or a cap 54 on the circuit end 50 of the body 46. The caps 52 and/or 54 are optionally formed from different materials from the body 46. For example, in some embodiments, the caps 52 and 54 of one or more of the electrical components 44 are formed from a metallic material, and the body 46 is formed from a ceramic material. In addition or alternative to the metallic and ceramic materials, the caps 52 and 54 and the body 46 may each include any other material. The cap 52 may be referred to herein as a "module cap", while the cap 54 may be referred to herein as a "circuit cap".

Figure 3:
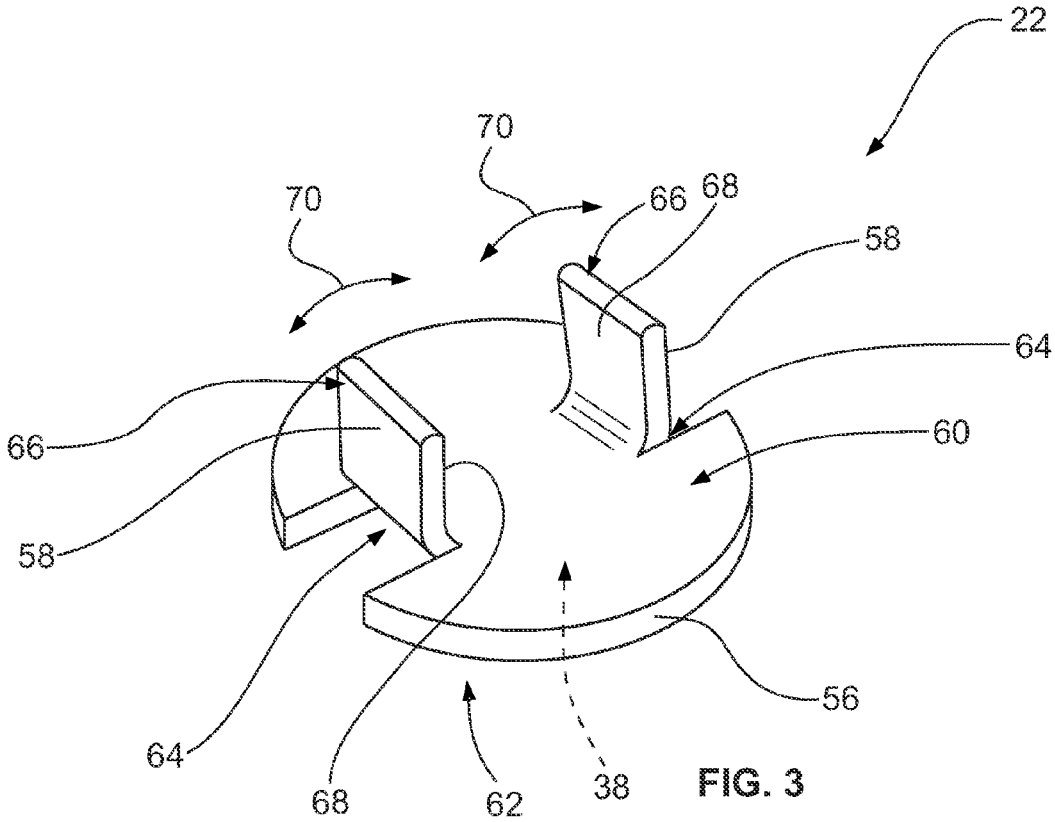
FIG. 3 is a perspective view of an exemplary embodiment of an electrical contact of the interconnect member shown in FIG. 2.

FIG. 3 is a perspective view of an exemplary embodiment of one of the electrical contacts 22. The electrical contact 22 includes a mounting base 56 and fingers 58 that extend outwardly from the mounting base 56. The mounting base 56 has a substrate side 60 and an opposite module side 62. The module side 62 includes the mating interface 38 of the electrical contact 22. The mounting base 56 is configured to be mechanically connected to the substrate 32 on the module side 34 of the substrate 32. The mounting base 56 is optionally sized such that a portion of the mounting base 56 extends over the module side 34 of the substrate 32 around the corresponding opening 42 (FIGS. 2 and 5).

The fingers 58 extend outwardly from the substrate side 60 of the mounting base 56. Each finger 58 extends a length from an end 64 that is connected to the mounting base 56 to a free end 66. The fingers 58 oppose each other. More particularly, each finger 58 includes a gripping surface 68 that faces the gripping surface 68 of the other finger 58. The fingers 58 are springs such that the free end 66 of each finger 58 is resiliently deflectable along a corresponding arc 70. The position of each finger 58 shown in FIG. 3 is the natural resting, or undeflected, position of the finger 58. When deflected along the corresponding arc 70 in either direction therealong, the finger 58 experiences a biasing force that acts along the arc 70 in the opposite direction to the direction of deflection to bias the finger 58 toward the undeflected position. Although two fingers 58 are shown, each electrical contact 22 may include any number of the fingers 58.

Referring again to FIG. 2, in the exemplary embodiment, the substrate 32 includes an array of metallic pads 72 that are used to mount the mounting bases 56 of the electrical contacts 22 on the substrate 32. The array of pads 72 is aligned with the array of openings 42 such that the pads 72 extend around corresponding openings 42 on the module side 34 of the substrate 32. In the exemplary embodiment, the mounting base 56 of each electrical contact 22 is soldered to the corresponding pad 72 to mechanically connect the mounting base 56, and thus the electrical contacts 22, to the module side 34 of the substrate 32. In addition or alternatively to being soldered, the mounting base 56 of one or more of the electrical contacts 22 is mechanically connected to the corresponding pad 72 (which may or may not be metallic) on the module side 34 of the substrate 32 using an adhesive, using a press-fit (or interference) connection, using a snap-fit connection, and/or using another type of mechanical fastener, connection, and/or the like. Moreover, in alternative to the pad 72, the mounting base 56 of one or more of the electrical contacts 22 may be mechanically connected directly to the surface of the substrate 32 that defines the module side 34, such as, but not limited to, using an adhesive, using a press-fit (or interference) connection, using a snap-fit connection, and/or using another type of mechanical fastener, connection, and/or the like.

When the mounting base 56 of an electrical contact 22 is mechanically connected to the substrate 32 as shown in FIG. 2, the fingers 58 extend into the corresponding opening 42. The fingers 58 engage the corresponding electrical component 44 to hold a portion of the electrical component 44 therebetween. More particularly, the gripping surfaces 68 of the fingers 58 engage the cap 52 of the corresponding electrical component 44 such that the cap 52 is held between the fingers 58. The engagement between the gripping surfaces 68 of the fingers 58 and the cap 52 mechanically and electrically connects the electrical contact 22 to the cap 52 and thereby to the corresponding electrical component 44. In the exemplary embodiment, the mechanical connection between the fingers 58 and the cap 52 is created by an interference fit between the fingers 58 and the cap 52. Specifically, as the cap 52 is received between the fingers 58, the cap 52 deflects the free ends 66 of the fingers 58 from the undeflected positions in directions away from each other. The biasing forces experienced by the fingers 58 biasing the fingers 58 back toward the undeflected positions (and toward each other) exert a holding force on the cap 52 that holds the cap 52 between the fingers 58. Optionally, the gripping surfaces 68 of the fingers 58 are soldered to the cap 52. In addition or alternative to the interference fit, the fingers 58, the cap 52, and/or the solder connection between the fingers 58 and the cap 52, each electrical component 44 may be mechanically and/or electrically connected to the corresponding electrical contact 22 using any other structure, means, connection type, and/or the like, such as, but not limited to, using an adhesive and/or using another type of mechanical fastener, connection, and/or the like.

In the exemplary embodiment, the mating interfaces 38 of the electrical contacts 22 are contact pads that are configured to engage solder balls 74 (FIG. 5) that engage the contact pads 28 (FIG. 5) on the mating side 26 (FIGS. 1 and 5) of the electronic module 16. The solder balls 74 provide an electrical connection between the mating interfaces 38 of the electrical contacts 22 and the contact pads 28 of the electronic module 16. In some alternative embodiments, the mating interface 38 of one or more of the electrical contacts 22 directly engages the corresponding contact pad 28 of the electronic module 16. Moreover, in addition or alternatively to the contact pad, the mating interface 38 of one or more of the electrical contacts 22 may include another type of contact, such as, but not limited to, a solder tail, a pin that is configured to be press-fit into the electronic module 16 and/or an intervening structure, and/or the like.

FIG. 4 is a perspective view of an exemplary embodiment of one of the electrical contacts 24. The electrical contact 24 includes a base 76 having a substrate side 80 and an opposite circuit side 82. Fingers 78 extend outwardly from the base 76. In the exemplary embodiment, a pin 84 extends outwardly from the circuit side 82 of the base 76. The pin 84 includes the mating interface 40 of the electrical contact 24. The electrical contact 24 is configured to be mechanically connected to the substrate 32 (FIGS. 2 and 5). The electrical contact 24 includes optional barbs 86 that extend outwardly from outer sides 88 of the fingers 78. The barbs 86 facilitate mechanically connecting the electrical contact 24 to the substrate 32 with an interference fit, as will be described below. Optionally, the base 76 is sized such that a portion of the base 76 extends over the circuit side 36 (FIGS. 2 and 5) of the substrate 32 around the corresponding opening 42 (FIGS. 2 and 5). The electrical contact 24 may include any number of the barbs 86.

The fingers 78 extend outwardly from the substrate side 80 of the base 76. Each finger 78 extends outwardly to a free end 90. The fingers 78 oppose each other in that the fingers 78 include inner sides 92 that face each other. The fingers 78 are springs such that the free end 90 of each finger 78 is resiliently deflectable along a corresponding arc 94. The position of each finger 78 shown in FIG. 4 is the undeflected position of the finger 78. When deflected along the corresponding arc 94 in either direction therealong, the finger 78 experiences a biasing force that acts along the arc 94 in the opposite direction to the direction of deflection to bias the finger 78 toward the undeflected position. The inner sides 92 of the fingers 78 optionally include barbs 96 that engage the corresponding electrical component 44 (FIGS. 2 and 5) to mechanically and electrically connect the electrical contact 24 to the corresponding electrical component 44, as will be described below. Although two fingers 78 are shown, each electrical contact 24 may include any number of the fingers 78.

In the exemplary embodiment, the pin 84 of each electrical contact 24 is configured to be press-fit into a corresponding one of the electrical vias 30 (FIG. 5) of the printed circuit 14 (FIGS. 1 and 5). Engagement between the pins 84 and the conductive materials of the electrical vias 30 provides an electrical connection between the electrical contacts 24 and the electrical vias 30 of the printed circuit 14. In the exemplary embodiment, the pins 84 are Micro ACTION PIN® (MAP) contacts. Alternatively, one or more of the electrical contacts 24 includes another type of press-fit pin, such as, but not limited to, an eye-of-the needle pin and/or the like. Moreover, other types of contacts besides press-fit pins may be used in alternative embodiments for electrically connecting one or more of the electrical contacts 24 to the printed circuit 14, such as, but not limited to, surface mount contacts, solder tails, and/or the like.

Referring again to FIG. 2, in the exemplary embodiment, each electrical contact 24 is mechanically connected to the substrate 32 using an interference fit. More particularly, the barbs 86 of each electrical contact 24 engage the substrate 32 within the corresponding opening 42 with an interference fit to hold the electrical contact 24 to the substrate 32. In addition or alternatively to the barbs 86 and/or the interference fit, one or more of the electrical contacts 24 may be mechanically connected to the substrate 32 using an adhesive, using a snap-fit connection, and/or using another type of mechanical fastener, connection, and/or the like.

When an electrical contact 24 is mechanically connected to the substrate 32 as shown in FIG. 2, the fingers 78 extend into the corresponding opening 42 and engage the corresponding electrical component 44 to hold a portion of the electrical component 44 therebetween. More particularly, the barbs 96 of the fingers 78 engage the cap 54 of the corresponding electrical component 44 such that the cap 54 is held between the fingers 78. Engagement between the barbs 96 of the fingers 78 and the cap 54 mechanically and electrically connects the electrical contact 24 to the cap 54 and thereby to the corresponding electrical component 44. In the exemplary embodiment, the mechanical connection between the fingers 78 and the cap 54 is created by an interference fit between the fingers 78 and the cap 54. More particularly, as the cap 54 is received between the fingers 78, the cap 54 deflects the free ends 90 of the fingers 78 from the undeflected positions in directions away from each other. The biasing forces experienced by the fingers 78 biasing the fingers 78 back toward the undeflected positions (and toward each other) exerts a holding force on the cap 54 that holds the cap 54 between the fingers 78. Optionally, the barbs 96 of the fingers 58 are soldered to the cap 54. In addition or alternative to the interference fit, the fingers 78, the cap 54, and/or the solder connection between the fingers 78 and the cap 54, each electrical component 44 may be mechanically and/or electrically connected to the corresponding electrical contact 24 using any other structure, means, connection type, and/or the like, such as, but not limited to, using an adhesive and/or using another type of mechanical fastener, connection, and/or the like.

FIG. 5 is a cross-sectional view of a portion of the electronic module assembly 10. As illustrated in FIG. 5, the pins 84 of the electrical contacts 24 are received within the corresponding electrical vias 30 of the printed circuit 14. The pins 84 are engaged with the conductive materials of the electrical vias 30 such that the pins 84 are electrically connected to corresponding traces 98 of the printed circuit 14. Although the traces 98 are shown in FIG. 5 as being internal traces of the printed circuit 14, alternatively the corresponding electrical trace 98 of one or more of the pins 84 is located on an exterior surface of the printed circuit 14. Optionally, the electrical vias 30 are back-drilled as shown in FIG. 5, for example to facilitate preventing electrical stubs.

As described above, the bases 76 of the electrical contacts 24 are optionally sized such that a portion of the base 76 extends over the circuit side 36 of the substrate 32 around the corresponding opening 42. Accordingly, if a force is applied to the interconnect member 20 and/or the electronic module 16 to press the pins 84 into the electrical vias 30, such a force is transmitted to the pins 84 through the base 76 via the engagement of the circuit side 36 of the substrate 32 with the base 76, instead of through the electrical components 44. The bases 76 of the electrical contacts 24 may thereby facilitate preventing damage to the electrical components 44 as the pins 84 are pressed into the electrical vias 30.

In the exemplary embodiment, the electrical contacts 24 are mechanically connected to the substrate 32 via the interference fit between the barbs 86 and the substrate 32. The fingers 78 of the electrical contacts 24 hold the caps 54 of the corresponding electrical components 44 such that the electrical components 44 are electrically and mechanically connected to the corresponding electrical contacts 24. Similarly, the fingers 58 of the electrical contacts 22 hold the caps 52 of the corresponding electrical components 44. The electrical components 44 are thereby electrically and mechanically connected to the corresponding electrical contacts 22. In the exemplary embodiment, the bases 56 of the electrical contacts 22 are mechanically connected to the substrate 32 via the solder connection between the bases 56 and the corresponding pads 72. The mating interfaces 38 of the electrical contacts 22 are engaged with the corresponding solder balls 74, which are engaged with the corresponding contact pads 28 on the mating side 26 of the electronic module 16. The electrical contacts 22 are thereby electrically connected to the corresponding contact pads 28 of the electronic module 16.

The electrical components 44 extend between and electrically connect the corresponding electrical contacts 22 and 24 together. Each electrical component 44 provides an electrical path through the substrate 32 for electrical signals transmitted between the corresponding electrical contacts 22 and 24. Accordingly, the contact pads 28 on the electronic module 16 are electrically connected to the corresponding traces 98 of the printed circuit 14. The interconnect member 20 thereby electrically connects the electronic module 16 to the printed circuit 14. In the exemplary embodiment of the electrical components 44, the electrical components 44 block DC from being transmitted in at least one direction along the electrical paths between the electrical contacts 22 and 24. The electrical components 44 thereby facilitate blocking DC coupling between the electronic module 16 and another component (not shown) within a larger, or host, electronic system (not shown) that includes the electronic module assembly 10. When an electrical component 44 includes a capacitor, the capacitive value of the capacitor is optionally selected based at least on a data transmission rate of data signals that are conveyed along the electrical path of the electrical component 44. Similarly, when an electrical component 44 includes a resistor and/or a diode, the resistance value of the resistor and/or the value of the diode is optionally selected based at least on a data transmission rate of data signals that are conveyed along the electrical path of the electrical component 44.

Figure 6:
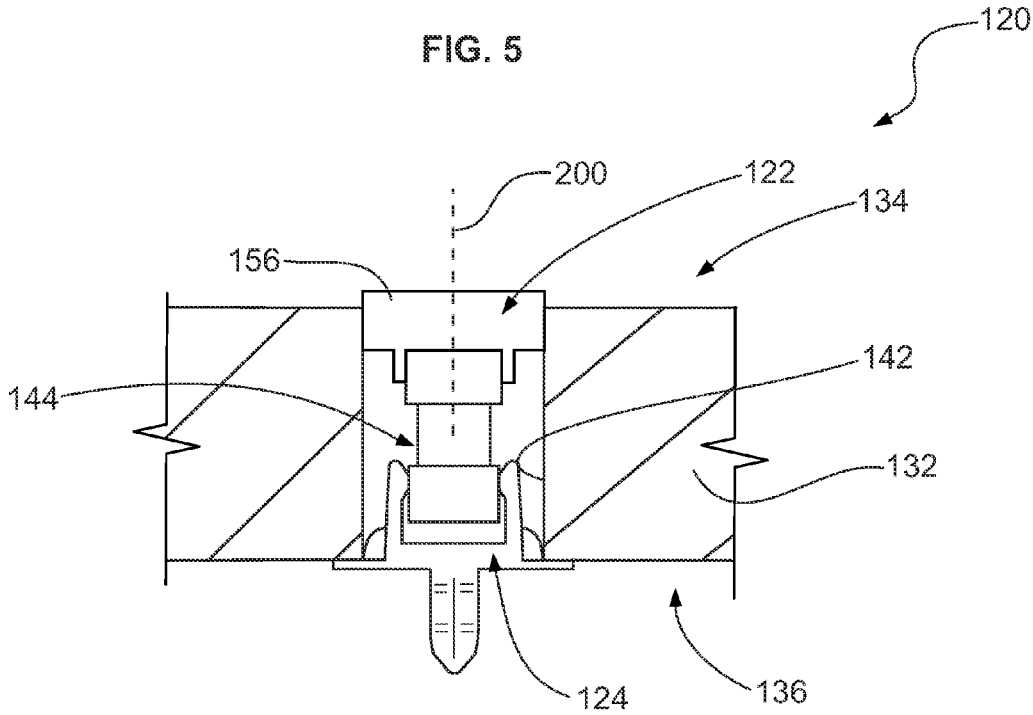
FIG. 6 is a cross-sectional view of a portion of an exemplary alternative embodiment of an interconnect member.

FIG. 6 is a cross-sectional view of a portion of an exemplary alternative embodiment of an interconnect member 120. The interconnect member 120 includes a dielectric substrate 132 that holds an array of electrical contacts 122 and an array of electrical contacts 124. The substrate 132 includes a module side 134 and an opposite circuit side 136. The electrical contacts 122 are arranged within the array along the module side 134 of the substrate 132 for electrical connection to the electronic module 16 (FIGS. 1 and 5). The electrical contacts 124 are arranged within the array along the circuit side 136 of the substrate 132 for electrical connection to the printed circuit 14 (FIGS. 1 and 5). The electrical contacts 122 may be referred to herein as "module contacts", while the electrical contacts 124 may be referred to herein as "circuit contacts".

The substrate 132 includes an array of openings 142 that extend through the substrate 132. The interconnect member 120 includes a plurality of electrical components 144. Each electrical component 144 is held within a corresponding opening 142 and is electrically connected to the corresponding electrical contacts 122 and 124. Within the corresponding opening 142, the electrical component 144 extends between and electrically connects the corresponding electrical contacts 122 and 124 together. Each electrical component 144 thereby provides an electrical path through the substrate 132 for electrical signals transmitted between the corresponding electrical contacts 122 and 124. In the exemplary embodiment of the electrical components 144, the electrical components 144 include diodes that block transmission of the corresponding electrical signals in one direction along the electrical paths between the electrical contacts 122 and 124. Each of the diodes may block transmission of the corresponding electrical signal in either direction along the electrical path between the corresponding electrical contacts 122 and 124. The value of each diode is optionally selected based at least on a data transmission rate of data signals that are conveyed along the electrical path of the electrical component 144.

The electrical contacts 122 include bases 156. In contrast to the mounting bases 56 (FIGS. 2, 3, and 5) of the electrical contacts 22 (FIGS. 1-3 and 5), the bases 156 of the electrical contacts 122 do not extend over the module side 134 of the substrate 132 around the corresponding opening 142. Moreover, rather than being soldered or otherwise mechanically connected to the module side 134 of the substrate 132, the bases 156 can float along a float axis 200. The floating ability of the bases 156 of the electrical contacts 122 may facilitate preventing damage to the electrical components 144, the electrical contacts 122, the electrical contacts 124, and/or other components of the interconnect member 120 caused by different coefficients of thermal expansion of the various components of the interconnect member 120. For example, when the interconnect member 120 is subjected to a solder flow or reflow operation, the various components of the interconnect member 120 may expand and/or contract at different rates, which may damage components (and/or the connections therebetween) that are rigidly connected together.

Figure 7:
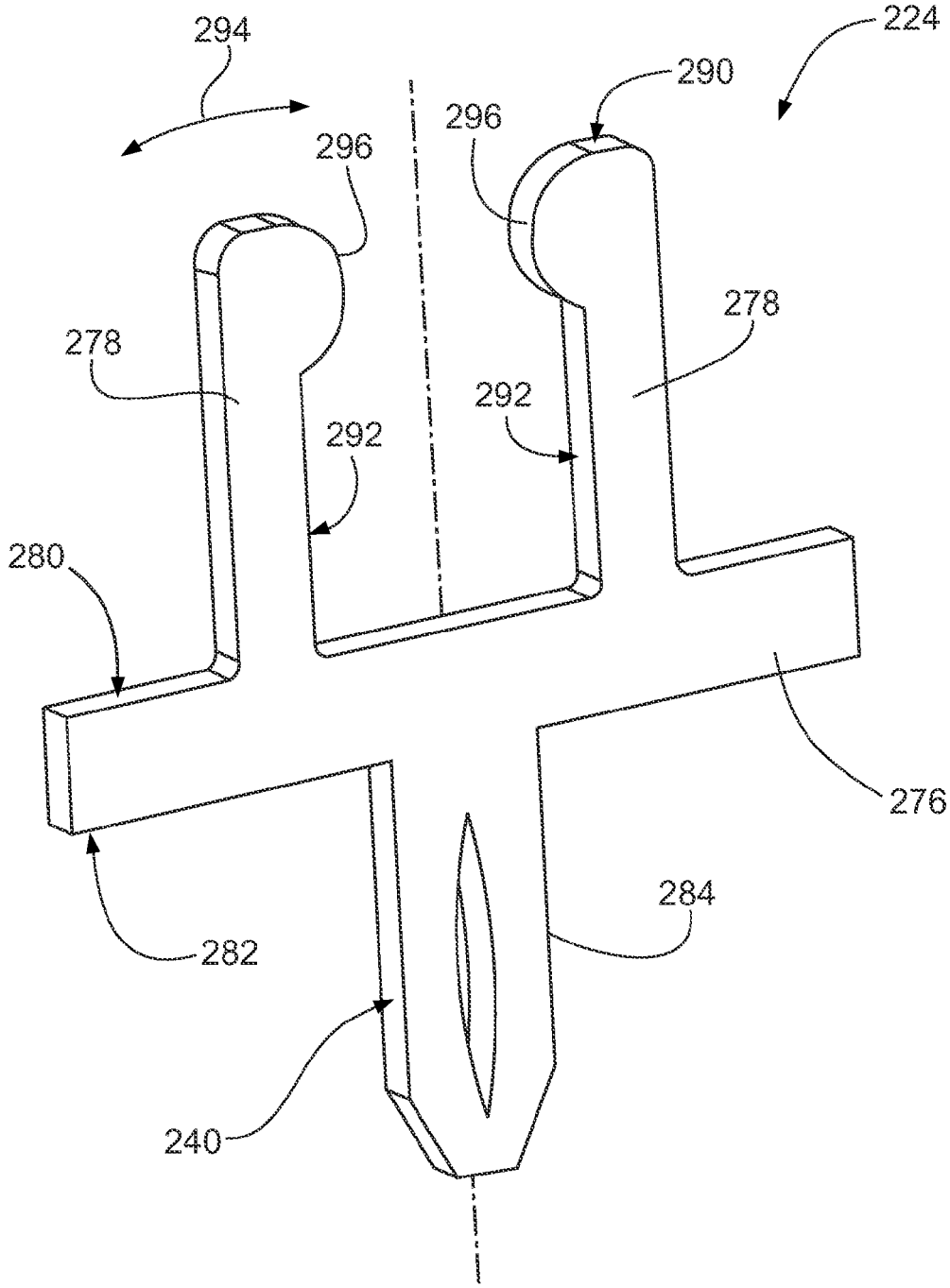
FIG. 7 is a perspective view of an exemplary alternative embodiment of an electrical contact of the interconnect member shown in FIG. 2.

FIG. 7 is a perspective view of an exemplary alternative embodiment of an electrical contact 224, which may be used in place of an electrical contact 24 (FIGS. 2, 4, and 5) or an electrical contact 124 (FIG. 6). The electrical contact 224 includes a base 276 having a substrate side 280 and an opposite circuit side 282. Fingers 278 extend outwardly from the base 276. In the exemplary embodiment, a pin 284 extends outwardly from the circuit side 282 of the base 276. The pin 284 includes a mating interface 240 of the electrical contact 224. The electrical contact 224 is configured to be mechanically connected to the substrate 32 (FIGS. 2 and 5). Optionally, the electrical contact 224 includes one or more barbs (not shown) to facilitate mechanically connecting the electrical contact 224 to the substrate 32 with an interference fit. The base 276 is optionally sized such that a portion of the base 276 extends over the circuit side 36 (FIGS. 2 and 5) of the substrate 32 around the corresponding opening 42 (FIGS. 2 and 5).

The fingers 278 extend outwardly from the substrate side 280 of the base 276. Each finger 278 extends outwardly to a free end 290. The fingers 278 oppose each other in that the fingers 278 include inner sides 292 that face each other. The fingers 278 are springs such that the free end 290 of each finger 278 is resiliently deflectable along a corresponding arc 294. The position of each finger 278 shown in FIG. 7 is the undeflected position of the finger 278. When deflected along the corresponding arc 294 in either direction therealong, the finger 278 experiences a biasing force that acts along the arc 294 in the opposite direction to the direction of deflection to bias the finger 278 toward the undeflected position. The inner sides 292 of the fingers 278 optionally include barbs 296 that engage the corresponding electrical component 44 (FIGS. 2 and 5) to mechanically and electrically connect the electrical contact 24 to the corresponding electrical component 44. Although two fingers 278 are shown, each electrical contact 224 may include any number of the fingers 278.

Figure 8:
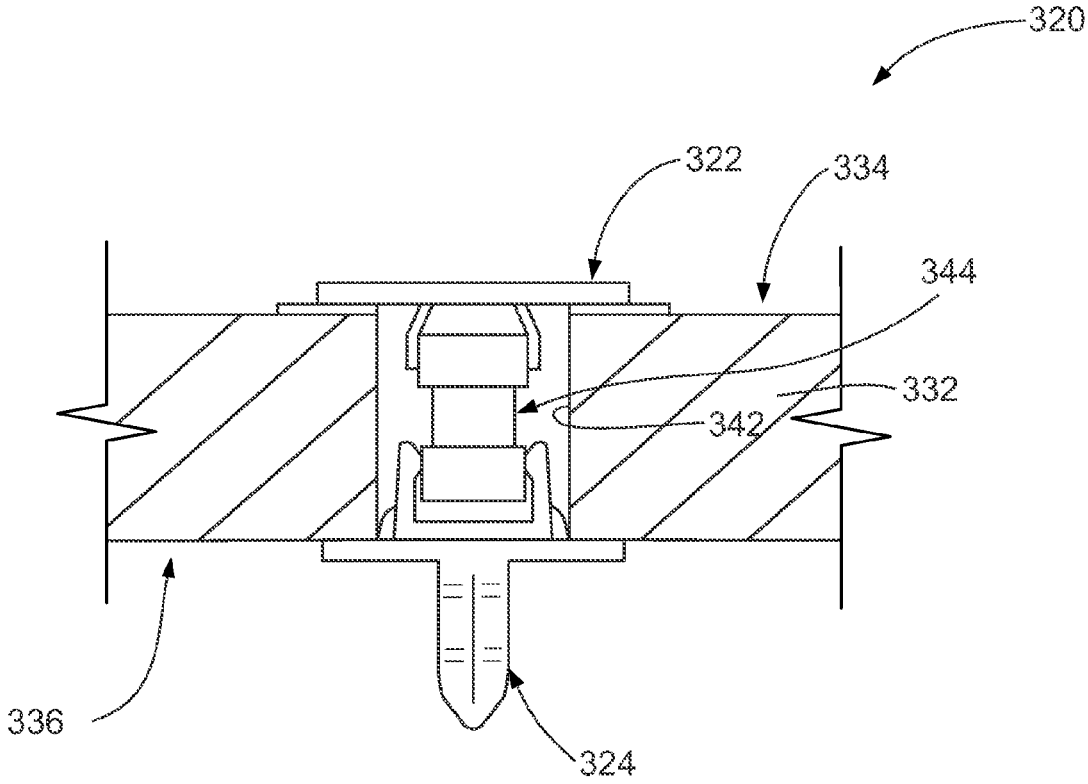
FIG. 8 is a cross-sectional view of a portion of another exemplary alternative embodiment of an interconnect member.

FIG. 8 is a cross-sectional view of a portion of an exemplary alternative embodiment of an interconnect member 320. The interconnect member 320 includes a dielectric substrate 332 that holds an array of electrical contacts 322 and an array of electrical contacts 324. The substrate 332 includes a module side 334 and an opposite circuit side 336. The electrical contacts 322 are arranged within the array along the module side 334 of the substrate 332 for electrical connection to the electronic module 16 (FIGS. 1 and 5). The electrical contacts 324 are arranged within the array along the circuit side 336 of the substrate 332 for electrical connection to the printed circuit 14 (FIGS. 1 and 5). The electrical contacts 322 may be referred to herein as "module contacts", while the electrical contacts 324 may be referred to herein as "circuit contacts".

The substrate 332 includes an array of openings 342 that extend through the substrate 332. The interconnect member 320 includes a plurality of electrical components 344. Each electrical component 344 is held within a corresponding opening 342 and is electrically connected to the corresponding electrical contacts 322 and 324. Within the corresponding opening 342, the electrical component 344 extends between and electrically connects the corresponding electrical contacts 322 and 324 together. Each electrical component 344 thereby provides an electrical path through the substrate 332 for electrical signals transmitted between the corresponding electrical contacts 322 and 324. In the exemplary embodiment of the electrical components 344, the electrical components 344 include resistors that limit the flow of electrical current along the electrical paths between the electrical contacts 322 and 324. In other words, the resistors limit the flow of the corresponding electrical signal. The resistance value of each resistor is optionally selected based at least on a data transmission rate of data signals that are conveyed along the electrical path of the electrical component 344.

The embodiments described and/or illustrated herein may provide an electrical module assembly having electrical components that are located closer to the electronic module than at least some known electronic module assemblies.

As used herein, the term "printed circuit" is intended to mean any electric circuit in which the conducting connections have been printed or otherwise deposited in predetermined patterns on an electrically insulating substrate. A substrate of the printed circuit 14 may be a flexible substrate or a rigid substrate. The substrate may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate is a rigid substrate fabricated from epoxy-glass, such that the printed circuit 14 is what is sometimes referred to as a "circuit board" or a "printed circuit board".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An interconnect member for electrically connecting an electronic module to a printed circuit, said interconnect member comprising:

a substrate having a module side and an opposite circuit side;

module contacts held by the substrate, the module contacts being arranged within an array along the module side of the substrate and comprising module mating interfaces that are configured to be electrically connected to the electronic module;

circuit contacts held by the substrate, the circuit contacts being arranged within an array along the circuit side of the substrate and comprising circuit mating interfaces that are configured to be electrically connected to the printed circuit; and electrical components extending between and electrically connecting corresponding module contacts to corresponding circuit contacts to provide electrical paths for electrical signals transmitted between the module and circuit contacts, wherein at least one of the electrical components modifies the corresponding electrical signal transmitted along the electrical path between the corresponding module and circuit contacts;

wherein the at least one electrical component modifies the corresponding electrical signal by at least one of blocking direct current (DC) in at least one direction along the electrical path between the corresponding module and circuit contacts, switching the electrical path between the corresponding module and circuit contacts between an open and closed state, amplifying the corresponding electrical signal, smoothing an output of the corresponding electrical signal, storing electrical energy, limiting the flow of electrical current of the corresponding electrical signal, blocking transmission of the corresponding electrical signal in one direction along the electrical path between the corresponding module and circuit contacts, or converting the corresponding electrical signal into a different form of energy.

2. The interconnect member according to claim 1, wherein the substrate comprises an array of openings that extend through the substrate, the electrical components being held within corresponding openings.

3. The interconnect member according to claim 1, wherein each electrical component comprises a body extending a length from a module end to a circuit end, each electrical component comprising a module cap on the module end of the body and a circuit cap on the circuit end of the body, wherein the circuit cap is mechanically and electrically connected to the corresponding circuit contact and the module cap is mechanically and electrically connected to the corresponding module contact.

4. The interconnect member according to claim 1, wherein the electrical components are soldered to the corresponding module and circuit contacts.

5. The interconnect member according to claim 1, wherein the substrate comprises an array of openings that extend through the substrate, the electrical components being held within corresponding openings, at least one of a module contact or a circuit contact comprising opposing fingers that extend into the corresponding opening and hold a portion of the corresponding electrical component therebetween.

6. The interconnect member according to claim 1, wherein the circuit contacts are held by the substrate using an interference fit between the circuit contacts and the substrate.

7. The interconnect member according to claim 1, wherein the substrate comprises an array of openings that extend through the substrate, the electrical components being held within corresponding openings, the circuit contacts comprising bases that extend around corresponding openings and are engaged with the circuit side of the substrate.

8. The interconnect member according to claim 1, wherein the module mating interfaces of the module contacts comprise contact pads that are configured to at least one of engage corresponding electrical contacts of the electronic module or engage corresponding solder balls on the electronic module.

9. The interconnect member according to claim 1, wherein the circuit mating interfaces of the circuit contacts comprise pins that are configured to be press-fit into corresponding electrical vias of the printed circuit.

10. The interconnect member according to claim 1, wherein the components comprise at least one of a capacitor, a resistor, a diode, a transistor, a transducer, a switch, an active electrical component, or a passive electrical component.

11. An interconnect member for electrically connecting an electronic module to a printed circuit, said interconnect member comprising:

a substrate having a module side and an opposite circuit side, wherein the substrate comprises an array of metallic pads extending on the module side of the substrate;

module contacts held by the substrate, the module contacts being arranged within an array along the module side of the substrate and comprising module mating interfaces that are configured to be electrically connected to the electronic module, the module contacts comprising mounting bases that are soldered to the corresponding said metallic pads;

circuit contacts held by the substrate, the circuit contacts being arranged within an array along the circuit side of the substrate and comprising circuit mating interfaces that are configured to be electrically connected to the printed circuit; and electrical components extending between and electrically connecting corresponding module contacts to corresponding circuit contacts to provide electrical paths for electrical signals transmitted between the module and circuit contacts, wherein at least one of the electrical components modifies the corresponding electrical signal transmitted along the electrical path between the corresponding module and circuit contacts.

12. An electronic module assembly comprising:

a printed circuit;

an electronic module; and an interconnect member electrically connecting the electronic module to the printed circuit, the interconnect member comprising:

a substrate having a module side and an opposite circuit side;

module contacts held by the substrate, the module contacts being arranged within an array along the module side of the substrate and comprising module mating interfaces that are electrically connected to the electronic module;

circuit contacts held by the substrate, the circuit contacts being arranged within an array along the circuit side of the substrate and comprising circuit mating interfaces that are electrically connected to the printed circuit; and electrical components extending between and electrically connecting corresponding module contacts to corresponding circuit contacts to provide electrical paths for electrical signals transmitted between the module and circuit contacts, wherein at least one of the electrical components modifies the corresponding electrical signal transmitted along the electrical path between the corresponding module and circuit contacts;

wherein the at least one electrical component modifies the corresponding electrical signal by at least one of blocking direct current (DC) in at least one direction along the electrical path between the corresponding module and circuit contacts, switching the electrical path between the corresponding module and circuit contacts between an open and closed state, amplifying the corresponding electrical signal, smoothing an output of the corresponding electrical signal, storing electrical energy, limiting the flow of electrical current of the corresponding electrical signal, blocking transmission of the corresponding electrical signal in one direction along the electrical path between the corresponding module and circuit contacts, or converting the corresponding electrical signal into another form of energy.

13. The assembly according to claim 12, wherein the printed circuit comprises an array of electrical vias, the circuit mating interfaces of the circuit contacts comprising pins that are press-fit into corresponding electrical vias.

14. The assembly according to claim 12, wherein the substrate comprises an array of openings that extend through the substrate, the electrical components being held within corresponding openings.

15. The assembly according to claim 12, wherein each electrical component comprises a body extending a length from a module end to a circuit end, each electrical component comprising a module cap on the module end of the body and a circuit cap on the circuit end of the body, wherein the circuit cap is mechanically and electrically connected to the corresponding circuit contact and the module cap is mechanically and electrically connected to the corresponding module contact.

16. The assembly according to claim 12, wherein the substrate comprises an array of openings that extend through the substrate, the electrical components being held within corresponding openings, at least one of a module contact and a circuit contact comprising opposing fingers that extend into the corresponding opening and hold a portion of the corresponding electrical component therebetween.

17. The assembly according to claim 12, wherein the DC electrical components comprise at least one of a capacitor, a resistor, a diode, a transistor, a transducer, a switch, an active component, or a passive component.

18. An interconnect member for electrically connecting an electronic module to a printed circuit, said interconnect member comprising:

a substrate having a module side and an opposite circuit side;

module contacts held by the substrate, the module contacts being arranged within an array along the module side of the substrate and comprising module mating interfaces that are configured to be electrically connected to the electronic module;

circuit contacts held by the substrate, the circuit contacts being arranged within an array along the circuit side of the substrate and comprising circuit mating interfaces that are configured to be electrically connected to the printed circuit; and electrical components extending between and electrically connecting corresponding module contacts to corresponding circuit contacts to provide electrical paths between the module and circuit contacts, wherein at least one of the electrical components comprises at least one of a capacitor, a resistor, a diode, a transistor, a transducer, or a switch.

* * * * *